US012129655B2

(12) United States Patent
Radford et al.

(10) Patent No.: US 12,129,655 B2
(45) Date of Patent: Oct. 29, 2024

(54) JOINT SUPPORT INCLUDING ADHESIVE LAYER, SYSTEM INCLUDING JOINT SUPPORT, AND METHOD OF USE

(71) Applicant: CertainTeed Gypsum, Inc., Malvern, PA (US)

(72) Inventors: Craig Douglas Radford, Lake Tapps, WA (US); Thomas C. Molloy, Kent, WA (US)

(73) Assignee: CertainTeed Gypsum, Inc., Malvern, PA (US)

( * ) Notice: Subject to any disclaimer, the term of this patent is extended or adjusted under 35 U.S.C. 154(b) by 0 days.

(21) Appl. No.: 17/851,167

(22) Filed: Jun. 28, 2022

(65) Prior Publication Data

US 2022/0412098 A1 Dec. 29, 2022

Related U.S. Application Data

(60) Provisional application No. 63/215,821, filed on Jun. 28, 2021.

(51) Int. Cl.

| | |
|---|---|
| ***E04F 13/04*** | (2006.01) |
| ***E04F 13/06*** | (2006.01) |
| ***E04F 19/06*** | (2006.01) |

(52) U.S. Cl.

CPC ..... *E04F 13/045* (2013.01); *E04F 13/06* (2013.01); *E04F 19/062* (2013.01); *E04F 2013/063* (2013.01)

(58) Field of Classification Search

CPC ..... E04F 13/045; E04F 13/06; E04F 19/062; E04F 2013/063; E04F 13/042

See application file for complete search history.

(56) References Cited

U.S. PATENT DOCUMENTS

| | | | | |
|---|---|---|---|---|
| 4,042,739 | A | 8/1977 | Emal et al. | |
| 5,333,433 | A | 8/1994 | Porambo et al. | |
| 6,413,606 | B1 | 7/2002 | Calderon | |
| 7,141,284 | B2 | 11/2006 | Newton et al. | |
| 8,613,831 | B2 | 12/2013 | Wild | |
| 9,388,582 | B1 | 7/2016 | Smythe | |
| 10,352,050 | B2 | 7/2019 | Neill et al. | |
| 2003/0181114 | A1* | 9/2003 | Newton | E04F 13/042 428/40.1 |

(Continued)

OTHER PUBLICATIONS

"Lorama Polysaccharide Binder" LTB TM 29, Lorama Group, 1 page, Apr. 5, 2017.

(Continued)

*Primary Examiner* — Patrick J Maestri

(74) *Attorney, Agent, or Firm* — McDonnell Boehnen Hulbert & Berghoff LLP

(57) ABSTRACT

The present disclosure relates generally to building surface joint supports, for example, configured to bridge and support the seam between two building surface panels. The present disclosure relates more particularly to a joint support configured to support a joint between building surface panels. The joint support includes a longitudinal support strip including a first end, a second end, a first side edge, a second side edge, an inner surface, and an outer surface. An inner layer of adhesive is distributed over the inner surface of the longitudinal support strip and is configured to bond with a joint compound. The adhesive of the inner layer includes a polysaccharide.

16 Claims, 7 Drawing Sheets

(56) References Cited

U.S. PATENT DOCUMENTS

| | | | | |
|---|---|---|---|---|
| 2006/0207738 | A1 | 9/2006 | Wild | |
| 2008/0176469 | A1* | 7/2008 | Dong | E04F 13/042 442/58 |
| 2017/0362477 | A1* | 12/2017 | Weinberger | C09J 133/08 |
| 2021/0079273 | A1 | 3/2021 | Kamath | |

OTHER PUBLICATIONS

Safety Data Sheet—according to 29 CFR 1910.1200 LTB TM 29, Lorama Group, 8 pages, Jan. 27, 2016 (revised Aug. 30, 2016).

* cited by examiner

JOINT SUPPORT INCLUDING ADHESIVE LAYER, SYSTEM INCLUDING JOINT SUPPORT, AND METHOD OF USE

CROSS-REFERENCE TO RELATED APPLICATIONS

This application claims the benefit of priority of U.S. Provisional Patent Application No. 63/215,821, filed Jun. 28, 2021, which is hereby incorporated herein by reference in its entirety.

BACKGROUND OF THE DISCLOSURE

1. Field of the Disclosure

The present disclosure relates generally to building surface joint supports, for example, configured to bridge and support the seam between two building surface panels. The present disclosure relates more particularly to a joint support including an adhesive layer configured to bond with a joint compound.

2. Technical Background

Prefabricated building surface panels, such as gypsum wallboards that are commonly referred to as drywall, are often used to construct building surfaces. The panels are attached to a supporting structure and positioned adjacent to one another to form the building surface. Once the panels are positioned and secured, the building surface may be finished using a joint compound to cover the joints between adjacent panels. The building surface may then be painted or covered with wallpaper.

In some instances, a joint support, such as joint tape or a corner bead, may be used to strengthen the seam at the joint between the building surface panels. The joint support may be either attached to or embedded in the joint compound. The joint support can help strengthen the connection that is formed by the joint compound between the neighboring building surface panels. The present inventors have recognized that improved adhesion between the joint support and the joint compound would help strengthen the joint between the building surface panels. The present inventors have also recognized that improving adhesion without burdening the workers who install the building surface would be attractive to both builders and customers.

SUMMARY OF THE DISCLOSURE

In one aspect, the present disclosure provides a joint support configured to support a joint between building surface panels, the joint support comprising:

a longitudinal support strip including a first end, a second end, a first side edge, a second side edge, an inner surface, and an outer surface; and an inner layer of adhesive distributed over the inner surface of the longitudinal support strip and configured to bond with a joint compound, the adhesive of the inner layer comprising a polysaccharide.

In another aspect, the disclosure provides a building surface construction using a joint support, the building surface construction comprising:

a first building surface panel;

a second building surface panel adjacent to the first building surface panel so as to form a joint between an edge of the first building surface panel and an edge of the second building surface panel;

an inner layer of joint compound covering the joint and extending over a portion of the first building surface panel and a portion the second building surface panel; and a joint support according to the disclosure adhered to the inner layer of joint compound.

In another aspect, the disclosure provides a method of installing the joint support according to the disclosure on a joint between two building surface panels so as to form the building surface construction according to the disclosure, the method comprising:

applying an inner layer of joint compound over a joint between a first building surface panel and a second building surface panel;

placing the inner surface of the joint support against the inner layer of joint compound so as to bridge the joint between the first building surface panel and the second building surface panel while the inner layer of joint compound is wet; and allowing the inner layer of joint compound to dry.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have recognized that improved adhesion between a joint support and joint compound would help strengthen the joint between adjacent building surface panels, and that improving adhesion without burdening the workers who install the building surface would be attractive to both builders and customers Accordingly, one aspect of the disclosure is a joint support configured to support a joint between building surface panels. The joint support includes a longitudinal support strip including a first end, a second end, a first side edge, a second side edge, an inner surface, and an outer surface. An inner layer of adhesive is distributed over the inner surface of the longitudinal support strip and is configured to bond with a joint compound. The adhesive of the inner layer includes a polysaccharide.

Figure 1:
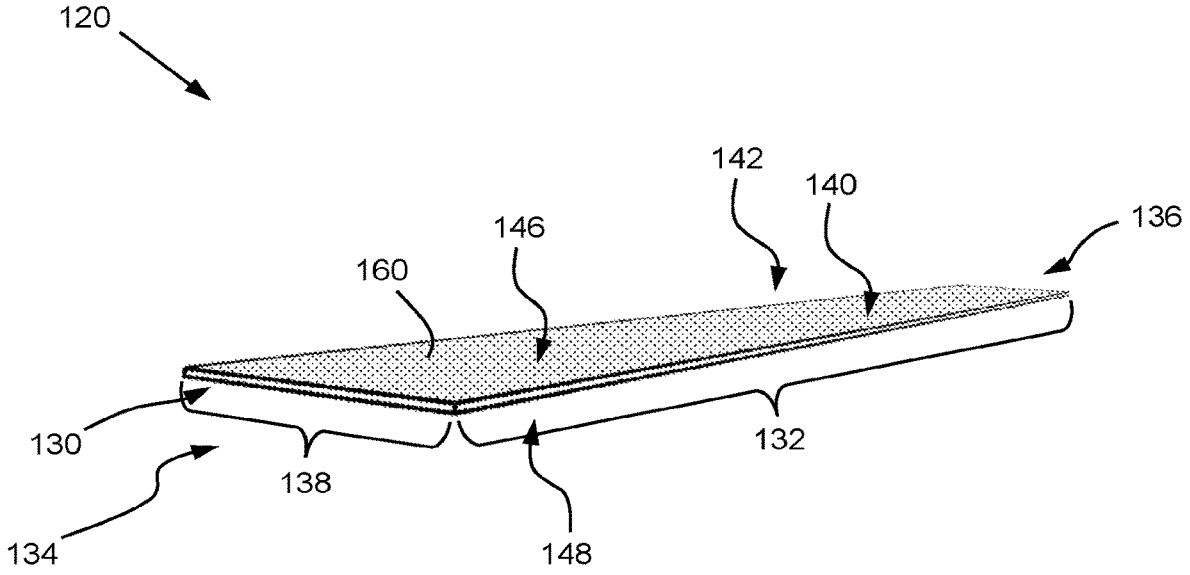
FIG. 1 is a schematic perspective view of a joint support according to an embodiment of the disclosure.

Such a joint support is shown in perspective view in FIG. 1. Joint support 120 includes a longitudinal support strip 130 that extends along a length 132 from a first end 134 to a second end 136. Support strip 130 also has a first side edge 140 and a second side edge 142. The distance between the first side edge 140 and second side edge 142 define a width 138 of support strip 130. Support strip 130 also includes an inner surface 146 configured to face a building surface construction and an outer surface 148 that is opposite inner surface 146. An inner layer of adhesive 160 is distributed over inner surface 146 of support strip 130 and is configured to bond with a joint compound so as to strengthen a joint upon which joint support 120 is positioned.

Figure 2:
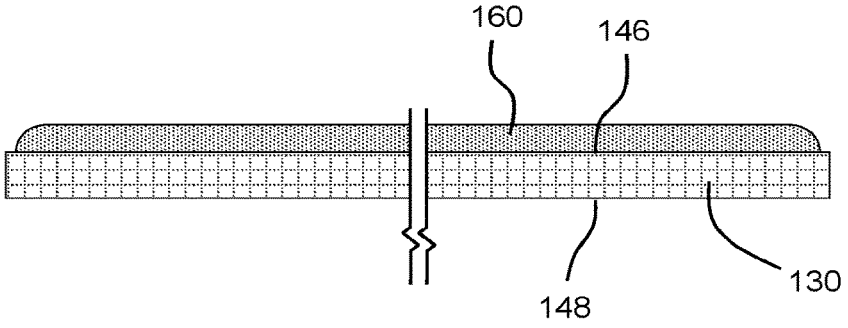
FIG. 2 is a schematic cross-sectional end view of the joint support of FIG. 1.

FIG. 2 shows a cross section of joint support 120 along its length. As illustrated, the inner layer of adhesive 160 of joint support 120 is formed as a film over the inner surface 146 of support strip 130. In other embodiments, the inner layer of adhesive may have another form, as described in more detail below.

Figure 3:
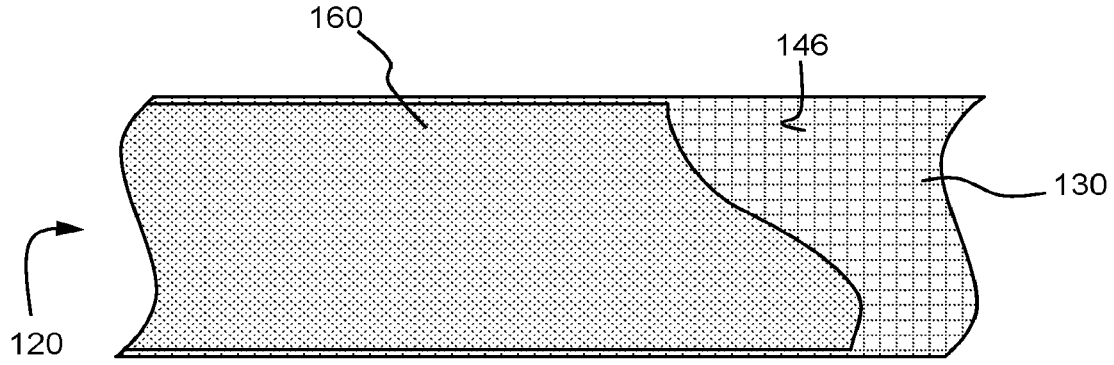
FIG. 3 is a schematic top view of the joint support of FIG. 1.

In certain embodiments of the joint support as otherwise described herein, the inner layer of adhesive is provided as a continuous film over the inner surface of the longitudinal support strip. For example, as shown in FIG. 3, inner layer of adhesive 160 extends continuously across support strip 130 so as to cover substantially all of inner surface 146. In other embodiments, the inner layer of adhesive is provided in a pattern over the inner surface of the longitudinal support strip.

Figure 4:
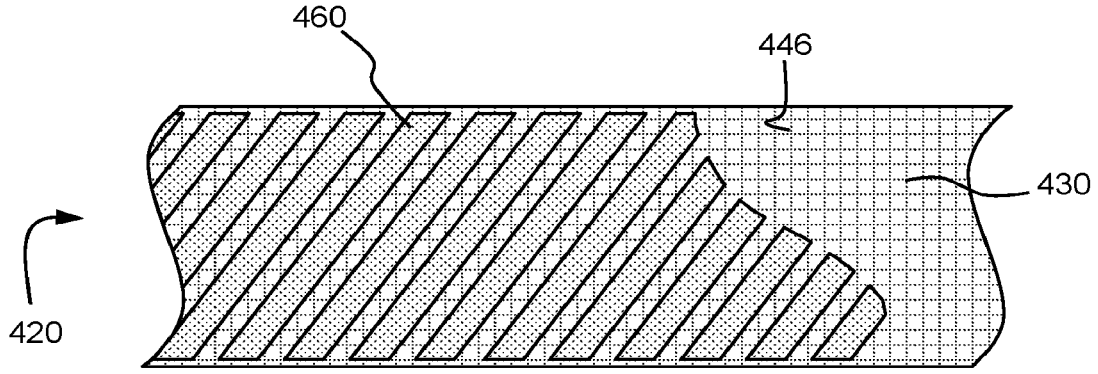
FIG. 4 is a schematic top view of a joint support according to another embodiment of the disclosure.
Figure 5:
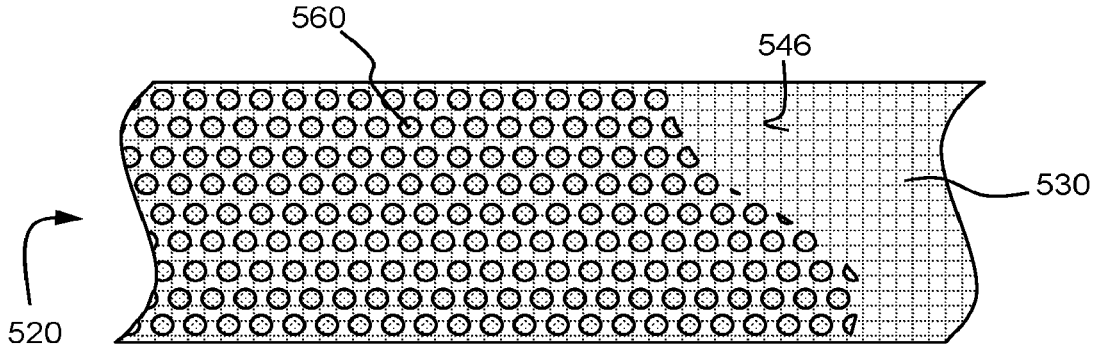
FIG. 5 is a schematic top view of a joint support according to another embodiment of the disclosure.

For example, such a joint support is shown in FIG. 4. Joint support 420 includes a support strip 430 and an inner layer of adhesive 460 provided on an inner surface 446 of support strip 430. Inner layer of adhesive 460 is configured as a plurality of stripes that extend across inner surface 430 such that portions of inner surface 430 are left exposed while other portions are covered by the dots of adhesive. FIG. 5 shows another embodiment of such a support strip 520, which includes an inner layer of adhesive 560 in the form of a pattern of dots that extend across inner surface 546 of a support strip 530 of joint support 520. Again, portions of inner surface 546 are covered by the adhesive of inner layer 560 while other portions of inner surface 546 are left exposed. By providing the inner layer of adhesive in a pattern, the overall quantity of adhesive that is used on the inner surface of the support strip may be reduced without reducing the thickness of the layer.

Other patterns and combinations of patterns are also possible. Further, the pattern of the adhesive may include text, logos or images. For instance, in some embodiments, the distribution of the adhesive of the inner layer of adhesive may be arranged to form letters or pictures, for example to identify the product, provide installation information to a user, or for other reasons.

In certain embodiments of the joint support as otherwise described herein, the inner layer of adhesive extends from the first end of the support strip to the second end of the support strip. For example, as shown in FIG. 1, the inner layer of adhesive 160 extends from the first end 134 of support strip 130 across the entire length 132 to the second end 136 of support strip 130. In other embodiments, there are gaps in the inner layer of adhesive leaving portions of the support strip exposed. For example, in some embodiments, portions of the ends of the support strip are free of the adhesive. Likewise, in some embodiments, there are gaps in the adhesive along the length of the joint support. For example, in some embodiments there may be gaps in the adhesive at regular intervals for segmenting the joint support.

In certain embodiments of the joint support as otherwise described herein, the inner layer of adhesive extends from the first side edge to the second side edge. For example, as shown in FIGS. 2 and 3, inner layer of adhesive 160 is formed as a film that extends entirely across inner surface 146 of support strip 130 from first side edge 140 to second side edge 142. Likewise, the pattern of the inner layer of adhesive 460 of joint support 420, as shown in FIG. 4 extends across the width of the joint support. Similarly, the pattern of the inner layer of adhesive 560 of joint support 520, as shown in FIG. 5, extends across the width of the joint support. In other embodiments, a portion of the support strip across the width of the joint support may be left exposed. For example, in some embodiments, the inner layer of adhesive is provided in bands that run along the length of the support strip and are separated by a gap. For instance, in some embodiments, there is a gap in the adhesive at the center of the joint support.

In certain embodiments of the joint support as otherwise described herein, the inner layer of adhesive has a film thickness of at least 0.1 mils, e.g., at least 0.2 mils. Further, in some embodiments, the inner layer of adhesive has a film thickness of no more than 5 mils, e.g., no more than 2 mils. For example, in some embodiments, the inner layer of adhesive has a film thickness in a range from 0.1 mils to 5 mils, e.g., from 0.2 mils to 2 mils.

In certain embodiments of the joint support as otherwise described herein, the inner layer of adhesive includes a colorant. For example, in some embodiments the inner layer of adhesive includes a pigment or other coloring substance so that the inner layer of adhesive has a color that contrasts with the inner surface of the support strip and is clearly visible. Providing the inner layer of adhesive with a colorant may make the presence of the adhesive more easily known, thereby helping to guide the user to know which side of the joint support to apply against the building surface. In other embodiments, the inner layer of adhesive is clear. Still, in other embodiments the inner layer of adhesive has a visible color without the use of a particular coloring substance, such as a pigment.

In certain embodiments of the joint support as otherwise described herein, the inner layer of adhesive is embedded in the support strip. For example, in some embodiments, the support strip has a certain amount of porosity, as explained in more detail below. In such embodiments, a portion of the inner layer of adhesive may extend into the openings or gaps in the support strip so as to be embedded in the support strip.

In certain embodiments of the joint support as otherwise described herein, the support strip is formed by a sheet of material. For example, in some embodiments, the support strip may be in the form of a joint tape. Further, in some embodiments, the sheet of material is a fibrous material, such as a sheet formed of woven or non-woven fibers. In some embodiments, the fibers are synthetic, while in other embodiments the fibers are natural fibers. In some embodiments the fibers are held together with a binder or provided in a matrix. In other embodiments, the sheet of material has another configuration. For example, in some embodiments the sheet of material is a polymer sheet or film. Further, in some embodiments the sheet may be rough or porous to improve the bond of the inner layer of adhesive to the support strip.

In certain embodiments of the joint support as otherwise described herein, the sheet of material that forms the support strip is formed of paper. Further, in certain embodiments of the joint support as otherwise described herein, the sheet of material includes fiberglass. For example, in some embodiments the sheet of material is a fiberglass mat.

Figure 6:
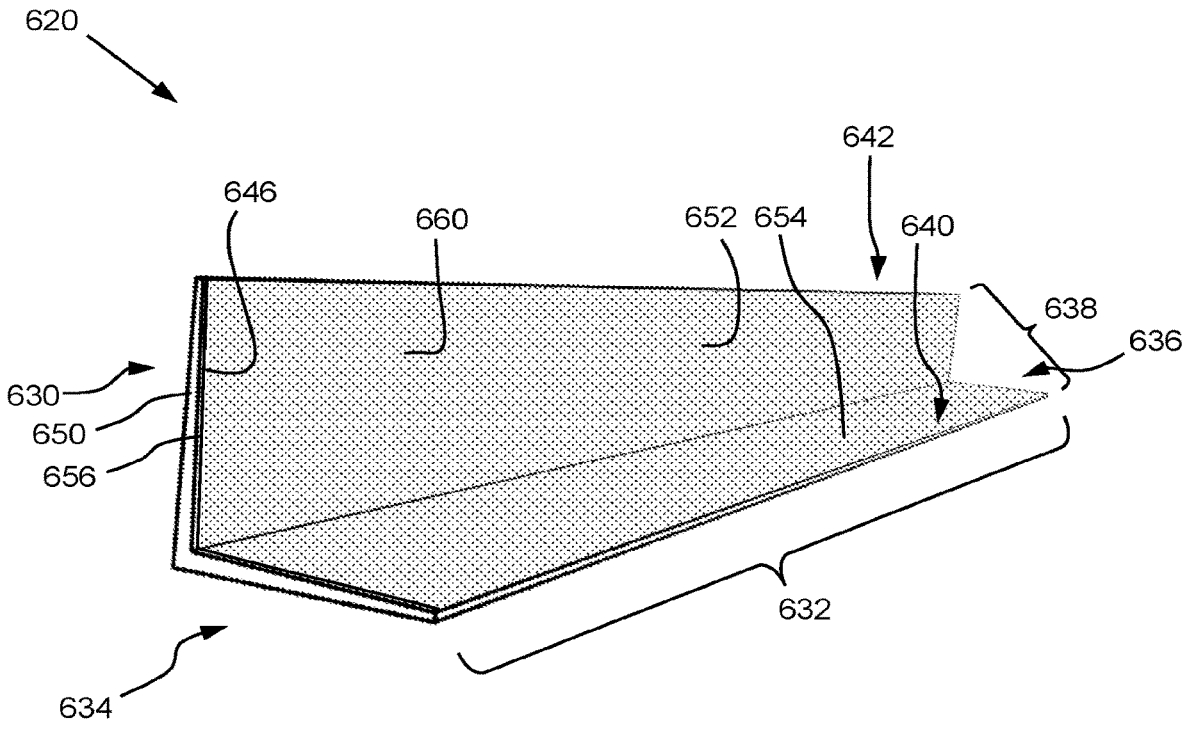
FIG. 6 is a schematic perspective view of a joint support according to another embodiment of the disclosure.

In certain embodiments of the joint support as otherwise described herein, the support strip includes a structural body and an inner facing sheet disposed on the structural body that forms the inner surface of the support strip. Such an embodiment is shown in FIG. 6. Joint support 620 includes a longitudinal support strip 630 that extends along a length 632 from a first end 634 to a second end 636. Support strip 630 also has a first side edge 640 and a second side edge 642. The distance between the first side edge 640 and second side edge 642 define a width 638 of support strip 630.

Support strip 630 is formed by a structural body 650 and an inner facing sheet 656 disposed on structural body 650. Inner facing sheet 656 forms an inner surface 646 of support strip 630 and is configured to face a building surface. An inner layer of adhesive 660 is distributed over the inner surface 646 formed by inner facing sheet 656 and is configured to bond with a joint compound so as to strengthen a joint upon which joint support 620 is positioned.

In certain embodiments of the joint support as otherwise described herein, the support strip includes an outer facing sheet. For example, in some embodiments, opposing facing sheets are disposed on both the inner and outer surfaces of the structural body, such that the entire surface of the structural body is covered by a facing sheet material. The facing sheet can improve adhesion between the support strip and both the layer of adhesive as well as the joint compound. These facing sheets can be made of various materials well suited for the purpose, and can include paper, fiberglass, and woven and non-woven polymer fibers and woven and non-woven natural fibers as well as combinations thereof.

In certain embodiments of the joint support as otherwise described herein, the structural body is flat. For example, in some embodiments the structural body of the support strip is a flat band that is covered by a facing sheet. In other embodiments the structural body may have another shape. For example, in some embodiments, the structural body may have the shape of a corner support. For example, joint support 620 is configured as a corner support that includes a support strip with a structural body 650 in the shape of a corner and configured to fit over a joint where two building surface panels meet at an angle.

In certain embodiments of the joint support as otherwise described herein, the structural body includes a first flange and a second flange. For example, joint support 620 includes a first flange 652 and second flange 654 that both run along the length of joint support 620 and are positioned at an angle to one another. In joint support 620 the first flange 652 and second flange 654 are approximately perpendicular to one another. In other embodiments, the first and second flanges are at an angle of slightly less than 90 degrees. Further, in other embodiments, the first and second flanges are disposed at another angle to one another and configured to be used with panels that disposed at an angle other than a perpendicular angle. Further still, in some embodiments, the joint support includes a flexible hinge between the first flange and the second flange. In such an embodiment, the first flange and second flange may initially be coplanar but configured to be folded about the hinge so as to form an angle between the flanges.

In certain embodiments of the joint support as otherwise described herein, the structural body is formed of plastic. For example, in some embodiments, the structural body comprises at least one of High Density Polyethylene (HDPE), Polyethylene Terephthalate (PET), or Acrylonitrile Butadiene Styrene (ABS). In other embodiments, the structural body is formed of another material. For example, in some embodiments, the structural body is formed of a heavy paper, a cardstock, or cardboard. Further, in some embodiments, the structural body is formed of metal or wood.

In certain embodiments of the joint support as otherwise described herein, the inner surface of the support strip is formed by paper and has a critical wax strength number of at least 18, e.g., at least 20, e.g., at least 22. The critical wax strength number may be established using a wax pick test according to the test method TAPPI T 459. Surprisingly, the joint support may exhibit sufficient adhesion even when the inner surface of the support strip is resistant to picking. For example, in some embodiments, the inner surface of the support strip is formed by a sheet of material that is smooth and has not been roughened (e.g., by sanding) and thus has a higher critical wax strength number. Surprisingly, the inner layer of adhesive material including a polysaccharide, as set forth above, is able to form strong adhesion between the joint support and the joint compound without a mechanically roughened inner surface or otherwise rough surface. Thus, various embodiments of the disclosure can use a support strip that has an unsanded inner surface.

On the other hand, in other embodiments, the inner surface of the support strip is roughened. For example, in some embodiments the inner surface of the support strip is formed by a sheet of material, such as paper, that has been sanded in order to loosen fibers of the sheet of material. These loosened fibers may improve adhesion between the joint support and joint compound. Likewise, in some embodiments, the inner surface of the support strip is formed by a paper having a critical wax strength below 18, such as 10, 12, 14 or 16.

In certain embodiments of the joint support as otherwise described herein, the joint support further includes an outer layer of adhesive distributed over the outer surface of the support strip and configured to bond with a joint compound. For example, an outer layer of adhesive applied on the outer surface of the support strip may increase adhesion between the joint support and a layer of joint compound that is applied over the installed joint support during installation.

In certain embodiments of the joint support as otherwise described herein, the composition of the inner layer of adhesive is the same as the composition of the outer layer of adhesive. In other embodiments, the composition of the inner layer of adhesive is different from the composition of the outer layer of adhesive. Likewise, in some embodiments, the thickness of the inner layer of adhesive is the same as the thickness of the outer layer of adhesive. On the other hand, in other embodiments, the thickness of the inner and outer layers of adhesive are different. For example, in some embodiments, the inner layer of adhesive is thicker than the outer layer of adhesive, while in other embodiments, the outer layer of adhesive is thicker.

In certain embodiments of the joint support as otherwise described herein, the inner layer of adhesive has a thickness of no more than 1 mil, e.g., no more than 0.5 mils, e.g., no more than 0.3 mils, e.g., no more than 0.1 mils.

In certain embodiments of the joint support as otherwise described herein, the joint support is a rolled product. For example, in some embodiments the support strip is flexible and may be rolled along its length, for example, into the form of a role of tape. Such a rolled product may be convenient for storage and transport of the joint support. When the joint support is to be used, it may be unrolled into a straight shape before being applied to a building surface.

In certain embodiments of the joint support as otherwise described herein, further comprising a release liner disposed on the inner layer of adhesive. Such a release liner may serve to prevent unwanted adhesion of the inner layer of adhesive with other structures or parts prior to installation of the joint support. For example, before applying the joint support to a building surface, the release liner may be peeled off or otherwise removed from the joint support so as to expose the inner layer of adhesive disposed on the inner surface of the support strip in order to secure the joint support to joint compound over a building surface joint. The release liner can be made of an appropriate material as known to one skilled in the art, such as a polymer sheet or a coated paper.

In certain embodiments of the joint support as otherwise described herein, a length of the joint support is at least 4 feet, e.g., at least 6 feet, e.g., at least 8 feet. Further, in some embodiments, the joint support is straight, and a length of the joint support is no more than 20 feet, e.g., no more than 15 feet, e.g., no more than 12 feet. In other embodiments, the joint support is a rolled product and the length of the joint support is much longer, for example, at least 50 feet, e.g., at least 100 feet.

In certain embodiments of the joint support as otherwise described herein, a width of the support strip is at least 1 inch, e.g., at least 2 inches. In some embodiments, a width of the support strip is no more than 8 inches, e.g., no more than 5 inches. For example, in some embodiments the width of the support strip is in a range from 1 inch to 8 inches, e.g., from 2 inches to 5 inches.

In another aspect, the disclosure provides a building surface construction using a joint support. The building surface construction includes a first building surface panel and a second building surface panel adjacent to the first building surface panel so as to form a joint between an edge of the first building surface panel and an edge of the second building surface panel. An inner layer of joint compound covers the joint and extends over a portion of the first building surface panel and a portion the second building surface panel. A joint support according to the disclosure is adhered to the inner layer of joint compound.

Figure 7:
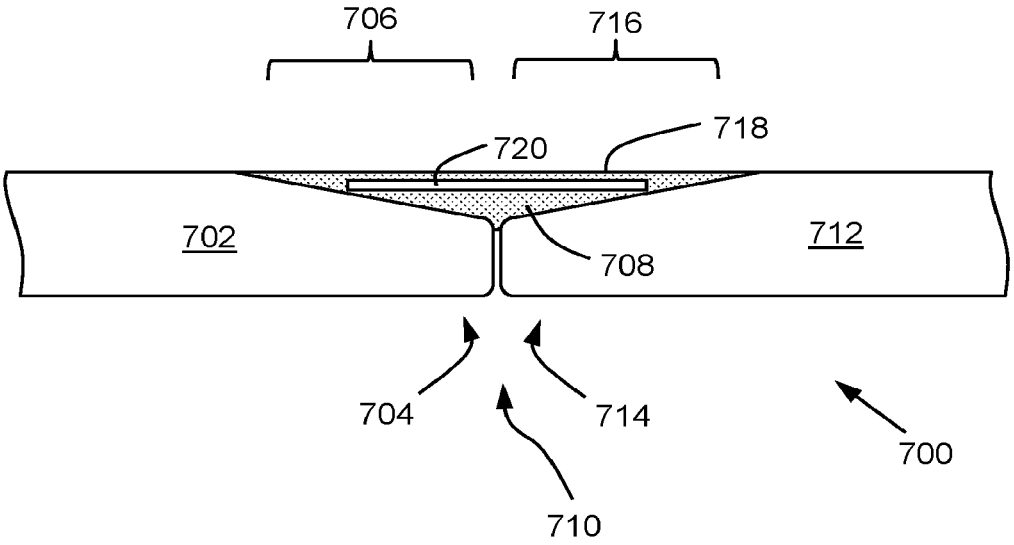
FIG. 7 is a schematic cross-sectional top view of a building surface construction according to an embodiment of the disclosure.

A cross section of a portion of such a building surface construction is shown in FIG. 7. Building surface construction 700 includes a first building surface panel 702 and a second building surface panel 712. The two building surface panels 702, 712 are positioned adjacent to one another such that an edge 704 of the first building surface panel 702 is aligned with and opposes an edge 714 of the second building surface panel 712. Accordingly, a joint 710 is formed between first building surface panel 702 and second building surface panel 712. An inner layer of joint compound 708 is applied over the joint 710 to cover the edge 704 of the first building surface panel 702 and the edge 714 of the second building surface panel 712. A joint support 720 is adhered to the inner layer of joint compound 708 and strengthens the joint 710 between the two building surface panels 702, 712.

In certain embodiments of the building surface construction as otherwise described herein, the first building surface panel and the second building surface panel are wall panels. In other embodiments, the building surface panels are other types of panels. For example, in some embodiments, the building surface panels are ceiling panels. On the other hand, in some embodiments, the building surface panels are versatile and for various surfaces. For example, in some embodiments the building surface panels are wall panels that may also be used for ceilings or other building surfaces.

In certain embodiments of the building surface construction as otherwise described herein, the first building surface panel and the second building surface panel are drywall panels, for example formed of a gypsum or plaster material. In other embodiments, the building surface panels are concrete panels. Still, in other embodiments, the building surface panels are formed of another material.

In certain embodiments of the building surface construction as otherwise described herein, the first building surface panel is substantially coplanar with the second building surface panel. For example, in building surface construction 700, the first building surface panel 702 is substantially coplanar with the second building surface panel 712 so as to form a flat building surface, such as a flat section of a wall or ceiling. In other embodiments, the first building surface panel and second building surface panel are angled with respect to one another. For example, in some embodiments, the first and second building surface panels form a corner and the joint support is a corner product that covers the corner joint between the two panels. These angles and corners can vary as necessary to accommodate the geometries of abutting panels. For example, they can be a 90 degree external corner, or a 90 degree internal corner. The corner could be a 30 degree angle or more, for example a 45 degree angle or more. The corner could be a 135 degree angle or less, for example a 120 degree angle or less.

In certain embodiments of the building surface construction as otherwise described herein, the first building surface panel includes a tapered portion along the edge that has a reduced thickness. For example, the front face of first building surface panel 702 of building surface construction 700 is angled inward so as to form a tapered section 706 along the edge 704. Similarly, the front face of second building surface panel 712 is also angled inward to form a tapered section 716 along the edge 714 of second building surface panel 712. The tapered sections 706 and 716 form a valley at the joint 710 between the two panels.

In certain embodiments of the building surface construction as otherwise described herein, the inner layer of joint compound is at least partially disposed in a valley formed by the tapered portion. For example, in building surface construction 700, the inner layer of joint compound 708 is disposed in the trough of the valley formed by the tapered section 706 of first building surface panel 702 and the tapered section 716 of second building surface panel 712.

In certain embodiments of the building surface construction as otherwise described herein, the building surface construction further includes an outer layer of joint compound disposed over the outer surface of the joint support. For example, as shown in building surface construction 700, an outer layer of joint compound 718 is provided over the joint support 720. In some embodiments, the outer layer of joint compound is substantially planar with a front surface of the first building surface panel and a front surface of the second building surface panel. For example, the outer surface of the outer layer of joint compound 718 forms a smooth flat surface with the front surfaces of the first building surface panel 702 and the second building surface panel 712.

In another aspect, the disclosure provides a method of installing the joint support of the disclosure on a joint between two building surface panels so as to form the building surface construction of the disclosure. The method includes applying an inner layer of joint compound over a joint between a first building surface panel and a second building surface panel. The inner surface of a joint support is then placed against the inner layer of joint compound so as to bridge the joint between the first building surface panel and the second building surface panel while the inner layer of joint compound is wet. The inner layer of joint compound is then allowed to dry.

Figure 8A:
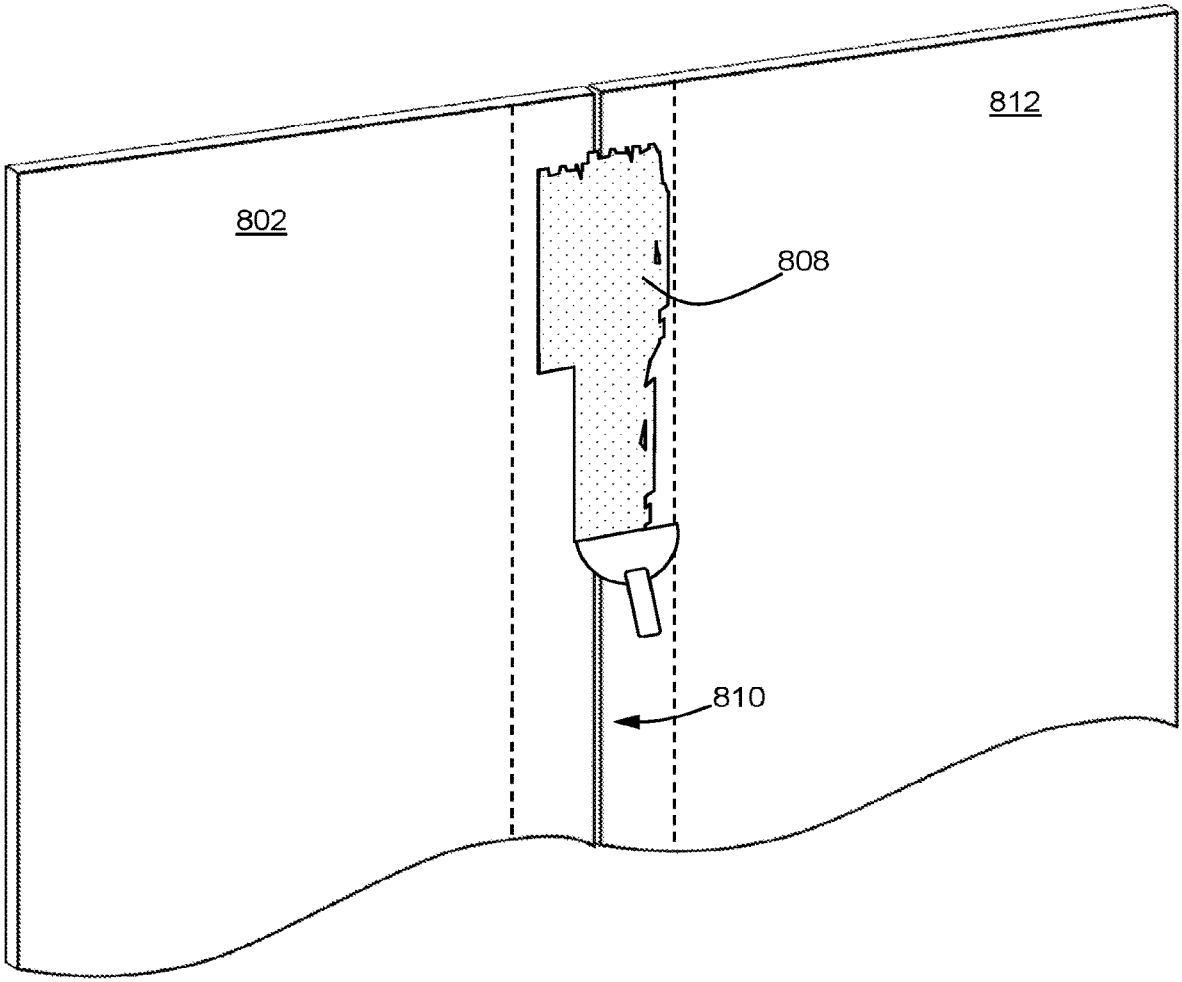
FIG. 8A is a schematic perspective view of part of a method according to an embodiment of the disclosure.
Figure 8B:
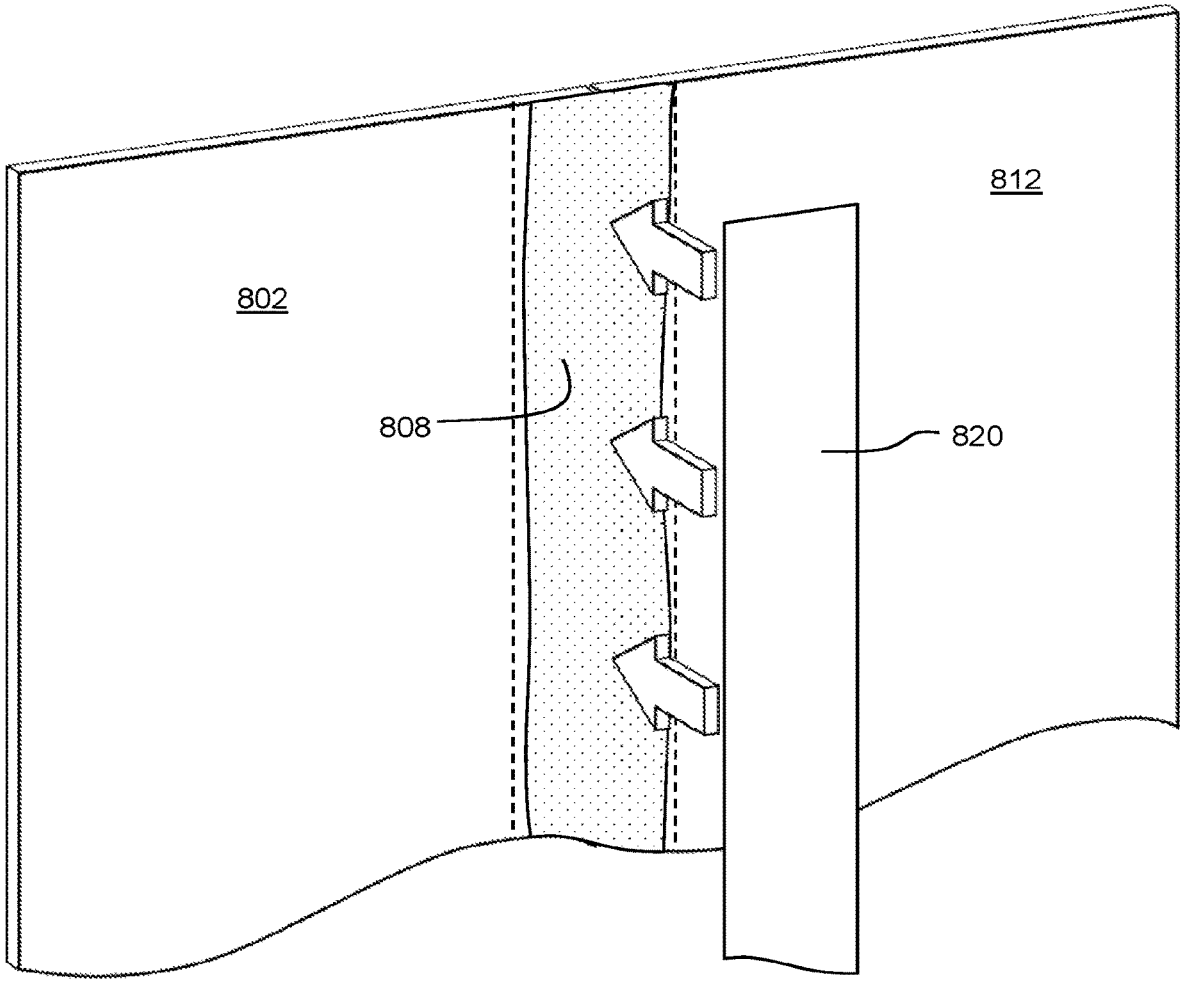
FIG. 8B is a schematic perspective view of another part of a method according to an embodiment of the disclosure.

An embodiment of such a method is shown in FIGS. 8A and 8B. As shown in FIG. 8A, a first building surface panel 802 is placed adjacent to a second building surface panel 812 so as to form a joint 810 therebetween. An inner layer of joint compound 808 is applied over the joint 810 such that the inner layer of joint compound 808 overlaps a portion of the first building surface panel 802 and a portion of the second building surface panel 812. As shown in FIG. 8B, while the inner layer of joint compound is wet, a joint support 820 is placed over the inner layer of joint compound 808 such that the inner adhesive layer on the joint support is pressed against the inner layer of joint compound 808. The joint support 820 thereby bridges the joint 810 between the first building surface panel 802 and the second building surface panel 812. In some embodiments, the inner layer of joint compound remains wet from its initial application when the joint support is positioned, while in other embodiments the inner layer of joint compound is rewet before the application of the joint support.

Figure 8C:
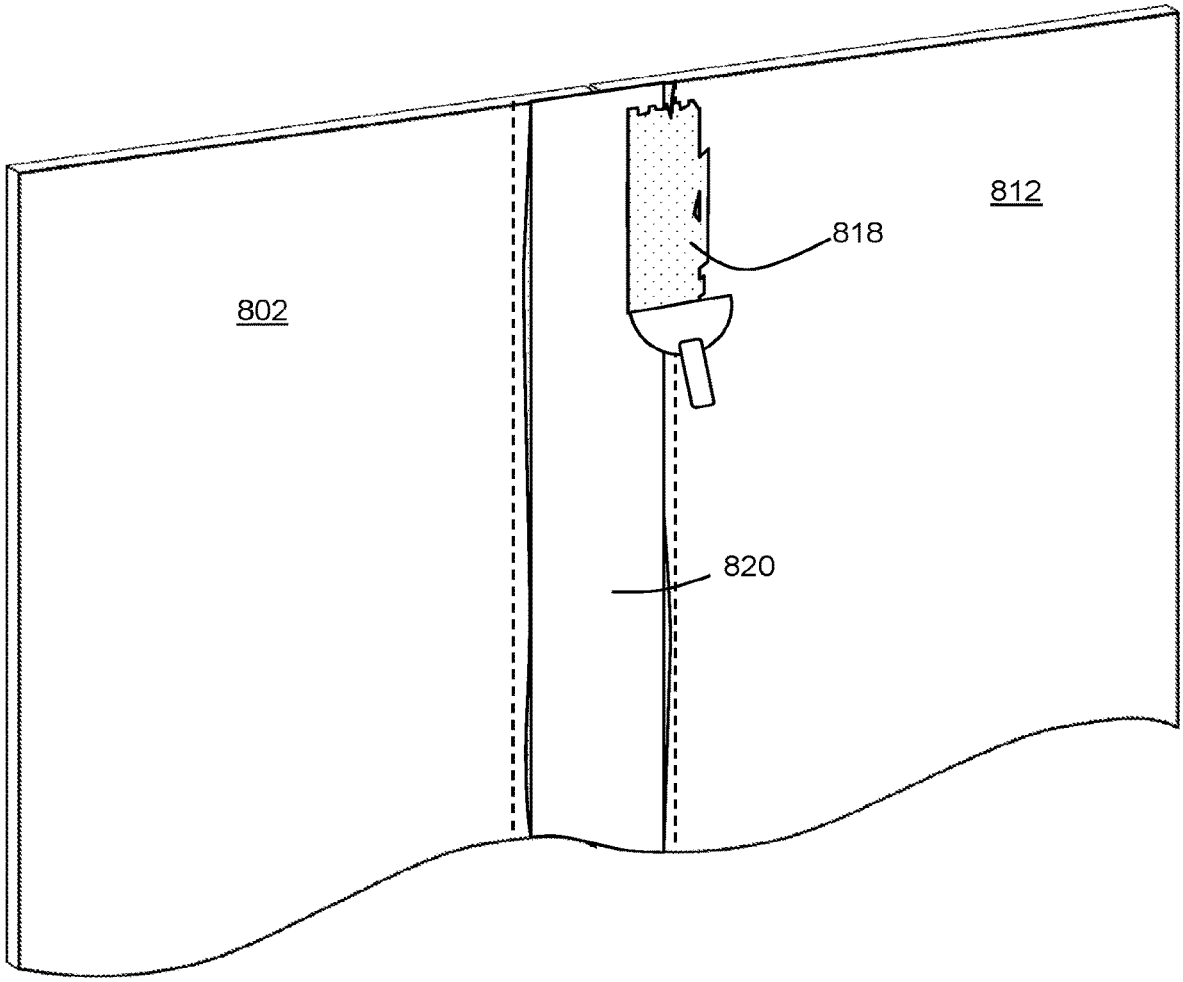
FIG. 8C is a schematic perspective view of another part of a method according to an embodiment of the disclosure.

In certain embodiments of the method as otherwise described herein, the method further includes applying an outer layer of joint compound over the joint support. For example, as shown in FIG. 8C, an outer layer of joint compound 818 may be applied over the joint support 820 to complete the building surface. In some embodiments, the outer layer of joint compound is applied over the joint support after the inner layer of joint compound has dried. In other embodiments, the outer layer of joint compound is applied over the joint support while the inner layer of joint compound and the joint support are still wet.

A variety of adhesives can be used as the adhesive distributed over the inner surface of the longitudinal support strip. The present inventors have determined that polysaccharide-based adhesives, can be especially desirable for use in the joint supports as described herein, as they can make a strong bond with joint compounds, especially joint compounds based on calcium carbonate or perlite. In certain embodiments, the adhesive distributed over the inner surface of the longitudinal support strip is at least 50% polysaccharide, e.g., at least 75% polysaccharide, or at least 90% polysaccharide, on a dry weight basis. A wide variety of polysaccharides are available for use as the adhesive. In certain embodiments, the polysaccharide component of the adhesive includes (or is) a starch, which may be modified in a variety of ways. In certain embodiments, the polysaccharide component includes (or is) a hydrolyzed starch (e.g., hydrolyzed by acid thinning). Of course, other polysaccharides can be used, such as dextrin, dextran, pullulan, xanthan gum, welan gum, gellan gum, gum Arabic, and chitosan. The adhesive can include other materials, e.g., rheology modifiers, diluents, tackifiers and solvents. For example, in certain embodiments, the adhesive may further include a fatty acid, such as oleic acid. One suitable polysaccharide-based adhesive is Lorama Polysaccharide Binder LTB™29, available from Lorama Group, Milton, Ontario, Canada.

In certain embodiments, when an adhesive is present on the outer surface of the longitudinal support strip, it can also be a polysaccharide-based adhesive as described above. In certain embodiments, the adhesive of the outer surface of the longitudinal support strip is the same as the adhesive of the inner surface of the longitudinal support strip.

A variety of joint compounds are suitable for use in the methods and systems described herein. The person of ordinary skill in the art can select a desirable joint compound, and a desirable polysaccharide adhesive for use therewith. In certain embodiments, the joint compound includes at least 50 wt % calcium carbonate (e.g., at least 75% calcium carbonate) on a dry weight basis.

EXAMPLES

The Examples that follow are illustrative of specific embodiments of the joint support and methods of the disclosure, and various uses thereof. They are set forth for explanatory purposes only, and are not to be taken as limiting the scope of the disclosure.

A number of adhesive compounds were applied in varying thickness to the surface of a strip of paper commonly used as joint tape. The adhesive compound was applied to the paper either undiluted or in a solution with water. Application of the compound to the paper was conducted by either dipping the paper or by using a wire wound rod to apply the composition or solution to a desired thickness. The paper was then allowed to dry thereby forming a joint support. The joint support was then applied to a surface of joint compound, which was again allowed to dry. The adhesion of the joint support to the joint compound was then quantified using the standard test method set forth by ASTM 474/475.

Table 1 shows the adhesion results for tests of various adhesive compounds according to the above procedure. The tests listed as controls used tape without any adhesive compound.

TABLE 1

Adhesive compounds on sanded paper

| Ref. | Adhesive compound Description | Applied Film Thickness mil | Paper preparation | Joint Compound name | Curing | Adhesion % |
|---|---|---|---|---|---|---|
| 1 | CPS104 | Dipped | Sanded | LAP | RT | 0 |
| 2 | PVOH | Dipped | Sanded | LAP | RT | 0 |
| 3 | Starch 105 | Dipped | Sanded | LAP | RT | 100 |
| 4 | Control | n/a | Sanded | LAP | RT | 85 |
| 5 | Starch 105 | Dipped | Unsanded | LAP | RT | 0 |
| 6 | CPS104 | Dipped | Sanded | Lite Topping | RT | 0 |
| 7 | PVOH | Dipped | Sanded | Lite Topping | RT | 0 |
| 8 | Starch 105 | Dipped | Sanded | Lite Topping | RT | 100 |
| 9 | Control | n/a | Sanded | Lite Topping | RT | 35 |

TABLE 1-continued

Adhesive compounds on sanded paper

| Ref. | Adhesive compound Description | Applied Film Thickness mil | Paper preparation | Joint Compound name | Curing | Adhesion % |
|---|---|---|---|---|---|---|
| 10 | Starch 105 | Dipped | Unsanded | Lite Topping | RT | 0 |
| 11 | Starch 105 | 0.3 | Unsanded | Lite Topping | RT | 0 |
| 12 | Starch 105 | 0.8 | Unsanded | Lite Topping | RT | 0 |
| 13 | Starch 105 | 1.4 | Unsanded | Lite Topping | RT | 0 |
| 14 | LTB29 (7.5%) | 1.4 | Unsanded | Lite Topping | RT | 100 |
| 15 | LTB29 (7.5%) | 1.4 | Unsanded | Lite Topping | RT | 100 |
| 16 | LTB29 (7.5%)* | 1.4 | Unsanded | Lite Topping | RT | 0 |
| 17 | LTB29 (7.5%) | 1.4 | Unsanded | Lite Topping | RT | 100 |
| 18 | Control | n/a | Unsanded | Lite Topping | RT | 0 |
| 19 | LTB29 (7.5%) | 1.4 | Unsanded | Lite Topping | RT | 100 |
| 20 | LTB29 (7.5%) | 0.8 | Unsanded | Lite Topping | RT | 100 |
| 21 | LTB29 (7.5%) | 0.3 | Unsanded | Lite Topping | RT | 50 |
| 22 | NOB44 (7.5%) | 1.4 | Unsanded | Lite Topping | RT | 0 |
| 23 | LTB29 (3.0%) | 1.4 | Unsanded | Lite Topping | RT | 0 |
| 24 | LTB29 (3.0%) | 0.8 | Unsanded | Lite Topping | RT | 0 |
| 25 | LTB29 (3.0%) | 0.3 | Unsanded | Lite Topping | RT | 0 |
| 26 | LTB29 (7.5%) | 1.4 | Unsanded | Taping | RT | 100 |
| 27 | Control | n/a | Unsanded | Taping | RT | 80 |
| 28 | LTB29 (7.5%) | 1.4 | Unsanded | Lite Taping | RT | 100 |
| 29 | Control | n/a | Unsanded | Lite Taping | RT | 0 |
| 30 | LTB29 (7.5%) | 1.4 | Unsanded | ONE | RT | 100 |
| 31 | Control | n/a | Unsanded | ONE | RT | 0 |
| 32 | LTB29 (7.5%) | 1.4 | Unsanded | AP | RT | 100 |
| 33 | Control | n/a | Unsanded | AP | RT | 10 |
| 34 | LTB29 (7.5%) | 1.4 | Unsanded | Lite Topping | RT | 100 |
| 35 | Control | n/a | Unsanded | Lite Topping | RT | 0 |
| 36 | LTB29 (7.5%) | 1.4 | Unsanded | AP | 40 F. | 25 |
| 37 | Control | n/a | Unsanded | AP | 40 F. | 0 |
| 38 | LTB29 (7.5%) | 1.4 | Unsanded | Lite Taping | 40 F. | 100 |
| 39 | Control | n/a | Unsanded | Lite Taping | 40 F. | 0 |
| 40 | LTB29 (7.5%) | 1.4 | Unsanded | Lite Topping | 40 F. | 50 |
| 41 | Control | n/a | Unsanded | Lite Topping | 40 F. | 0 |
| 42 | Manchem 441 | 1.4 | Unsanded | Lite Topping | RT | 0 |
| 43 | Manchem 376 | 1.4 | Unsanded | Lite Topping | RT | 0 |
| 44 | Manchem 441 (7.5%) | 1.4 | Unsanded | Lite Topping | RT | 0 |
| 45 | Machem 376 (7.5%) | 1.4 | Unsanded | Lite Topping | RT | 0 |
| 46 | Vinnapas 5010N (7.5%) | 1.4 | Unsanded | Lite Topping | RT | 0 |
| 47 | Ricol 135C (2%) | 1.4 | Unsanded | Lite Topping | RT | 0 |
| 48 | Vinnapas 5010N (25%) | 1.4 | Unsanded | Lite Topping | RT | 0 |

Tests 1-10 use tape that was dipped in adhesive compounds including a polyvinyl acetate emulsion ("CPS104"), polyvinyl alcohol ("PVOH"), and a modified corn starch ("Starch 105"), as well as a control. The coated sample was then applied to a surface of joint compound in the manner set forth above and the adhesion was tested according to ASTM 474/475. Test 1-5 show results using an all-purpose compound ("LAP"), while tests 6-10 show results using a topping compound ("Lite Topping"). Whereas the polyvinyl acetate emulsion ("CPS104"), polyvinyl alcohol ("PVOH") yielded no adhesion on the sanded paper, the modified corn starch, yielded 100% adhesion on sanded paper. In contrast, on unsanded paper, the modified corn starch did not yield any adhesion. Likewise, tests 11-13 illustrate the use of the modified corn starch on unsanded paper at varying thicknesses, where again no adhesion was observed.

Tests 14-18 illustrate that a polysaccharide (LTB29) in a concentration of 7.5% in a thickness of 1.4 mil on unsanded paper, was able to achieve 100% adhesion with the topping compound ("Lite Topping"). In contrast, the control was unable to achieve any adhesion using the topping compound ("Lite Topping") and unsanded paper, similar to the modified corn starch described above. Test 15 included a colorant in the adhesive composition, while test 17 did not, illustrating that the colorant had no impact on the adhesion. Test 16, which shows no adhesion, included the adhesive compound on the side of the tape facing away from the joint compound.

Tests 19-21 show that the polysaccharide (LTB29) in a concentration of 7.5% was able to achieve full adhesion between the unsanded paper and topping compound ("Lite Topping") at both the 1.4 mil thickness and 0.8 mil thickness. In contrast, at a thickness of only 0.3 mil, the adhesion of the polysaccharide (LTB29) was reduced to 50%. As shown by tests 25-27, at a lower concentration of 3%, the polysaccharide (LTB29) was unable to provide adhesion between the unsanded paper and topping compound ("Lite Topping").

Tests 30-35 demonstrate that polysaccharide (LTB29) was able to provide full adhesion between an unsanded tape and a variety of different joint compounds based on calcium carbonate, including taping compounds ("Taping") and ("Lite Taping"), and based on mixtures of calcium carbonate and perlite, including all-purpose compounds ("ONE") and ("AP") and a topping compound ("Lite Topping"). By comparison, without the adhesion compound (i.e., the control tests), only the taping compound ("Taping") was able to achieve 80% adhesion with the unsanded tape.

Tests 36-41 were conducted in a refrigerated environment and demonstrate that the polysaccharide (LTB29) was able to provide some adhesion to the unsanded paper even when dried at a temperature of 40° F. Indeed, the polysaccharide (LTB29) provided full adhesion to the taping compound ("Lite Taping") even at the colder temperature.

The remaining tests 46-48 show other adhesion compounds that were not able to provide any adhesion between the tape and the topping compound ("Lite Topping"). These adhesion compounds included an amino zircoaluminate (Manchem 376), a carboxy zicroaluminate (Manchem 441), a polyvinyl acetated copolymer powder (Vinnapas 5010), and a guar gum powder (Ricol 135C).

Additional aspects and embodiments are provided by the following enumerated embodiments, which can be combined in any number and in any fashion not technically or logically inconsistent.

Embodiment 1

A joint support configured to support a joint between building surface panels, the joint support comprising:

a longitudinal support strip including a first end, a second end, a first side edge, a second side edge, an inner surface, and an outer surface; and an inner layer of adhesive distributed over the inner surface of the longitudinal support strip and configured to bond with a joint compound, the adhesive of the inner layer comprising a polysaccharide.

Embodiment 2

The joint support according to claim 1, wherein the inner layer of adhesive is provided as a continuous film over the inner surface of the longitudinal support strip.

Embodiment 3

The joint support according to claim 1, wherein the inner layer of adhesive is provided in a pattern over the inner surface of the longitudinal support strip.

Embodiment 4

The joint support according to any of claims 1 to 3, wherein the inner layer of adhesive extends from the first end of the support strip to the second end of the support strip.

Embodiment 5

The joint support according to any of claims 1 to 4, wherein the inner layer of adhesive extends from the first side edge to the second side edge.

Embodiment 6

The joint support according to any of claims 1 to 5, wherein the inner layer of adhesive has a film thickness of at least 0.1 mils, e.g., at least 0.2 mils.

Embodiment 7

The joint support according to any of claims 1 to 6, wherein the inner layer of adhesive has a film thickness of no more than 5 mils, e.g., no more than 2 mils.

Embodiment 8

The joint support according to any of claims 1 to 7, wherein the inner layer of adhesive includes a colorant.

Embodiment 9

The joint support according to any of claims 1 to 8, wherein the inner layer of adhesive is embedded in the support strip.

Embodiment 10

The joint support according to any of claims 1 to 9, wherein the support strip is formed by a sheet of material.

Embodiment 11

The joint support according to claim 10, wherein the sheet of material is a fibrous material.

Embodiment 12

The joint support according to claim 10 or claim 11, wherein the sheet of material is paper.

Embodiment 13

The joint support according to claim 10 or claim 11, wherein the sheet of material includes fiberglass.

Embodiment 14

The joint support according to any of claims 1 to 8, wherein the support strip includes a structural body and an inner facing sheet disposed on the structural body that forms the inner surface of the support strip.

Embodiment 15

The joint support according to claim 14, wherein the support strip includes an outer facing sheet.

Embodiment 16

The joint support according to claim 14 or claim 15, wherein the structural body is flat.

Embodiment 17

The joint support according to any of claims 14 to 16, wherein the structural body includes a first flange and a second flange.

Embodiment 18

The joint support according to any of claims 14 to 17, wherein the joint support includes a flexible hinge between the first flange and the second flange.

Embodiment 19

The joint support according to any of claims 14 to 16, wherein the structural body is in the shape of a corner.

Embodiment 20

The joint support according to any of claims 14 to 19, wherein the structural body is formed of plastic.

Embodiment 21

The joint support according to claim 20, wherein the structural body comprises at least one of High Density Polyethylene (HDPE), Polyethylene Terephthalate (PET), or Acrylonitrile Butadiene Styrene (ABS).

Embodiment 22

The joint support according to any of claims 1 to 21, wherein the inner surface of the support strip is formed by paper and has a critical wax strength number of at least 18, e.g., at least 20, e.g., at least 22.

Embodiment 23

The joint support according to any of claims 1 to 22, further comprising an outer layer of adhesive distributed over the outer surface of the support strip and configured to bond with a joint compound.

Embodiment 24

The joint support according to claim 23, wherein the composition of the inner layer of adhesive is the same as the composition of the outer layer of adhesive.

Embodiment 25

The joint support according to any of claims 1 to 24, wherein the joint support is a rolled product.

Embodiment 26

The joint support according to any of claims 1 to 25, wherein further comprising a release liner disposed on the inner layer of adhesive.

Embodiment 27

The joint support according to any of claims 1 to 26, wherein a length of the joint support is at least 4 feet, e.g., at least 6 feet, e.g., at least 8 feet.

Embodiment 28

The joint support according to any of claims 1 to 27, wherein the joint support is substantially planar and a length of the joint support is no more than 20 feet, e.g., no more than 15 feet, e.g., no more than 12 feet.

Embodiment 29

The joint support according to any of claims 1 to 28, wherein a width of the support strip is at least 1 inch, e.g., at least 2 inches.

Embodiment 30

The joint support according to any of claims 1 to 29, wherein a width of the support strip is no more than 8 inches, e.g., no more than 5 inches.

Embodiment 31

A building surface construction using a joint support, the building surface construction comprising:

a first building surface panel;

a second building surface panel adjacent to the first building surface panel so as to form a joint between an edge of the first building surface panel and an edge of the second building surface panel;

an inner layer of joint compound covering the joint and extending over a portion of the first building surface panel and a portion the second building surface panel; and a joint support according to any of claims 1 to 30 adhered to the inner layer of joint compound.

Embodiment 32

The building surface construction according to claim 31, wherein the first building surface panel and the second building surface panel are wall panels.

Embodiment 33

The building surface construction according to claim 31 or claim 32, wherein the first building surface panel and the second building surface panel are drywall panels.

Embodiment 34

The building surface construction according to any of claims 31 to 33, wherein the first building surface panel is substantially coplanar with the second building surface panel.

Embodiment 35

The building surface construction according to any of claims 31 to 34, wherein the first building surface panel includes a tapered portion along the edge that has a reduced thickness.

Embodiment 36

The building surface construction according to claim 35, wherein the inner layer of joint compound is at least partially disposed in a valley formed by the tapered portion.

Embodiment 37

The building surface construction according to any of claims 31 to 33, wherein the first building surface panel is perpendicular to the second building surface panel Embodiment 38

The building surface construction according to any of claims 31 to 37, further comprising an outer layer of joint compound disposed over the outer surface of the joint support.

Embodiment 39

A method of installing the joint support according to any of claims 1 to 30 on a joint between two building surface panels so as to form the building surface construction according to any of claims 31 to 38, the method comprising:

applying an inner layer of joint compound over a joint between a first building surface panel and a second building surface panel;

placing the inner surface of the joint support against the inner layer of joint compound so as to bridge the joint between the first building surface panel and the second building surface panel while the inner layer of joint compound is wet; and allowing the inner layer of joint compound to dry.

Embodiment 40

The method according to claim 39, further comprising applying an outer layer of joint compound over the joint support.

Embodiment 41

The method according to claim 40, wherein the outer layer of joint compound is applied over the joint support after the inner layer of joint compound is dried.

Embodiment 42

The joint support, building surface construction, or method according to any of claims 1-41, wherein the adhesive includes at least 50 wt % polysaccharide (e.g., at least 75 wt %, or at least 90 wt %) on a dry weight basis.

Embodiment 43

The joint support, building surface construction, or method according to any of claims 1-42, wherein the polysaccharide component of the adhesive comprises (or is) a starch.

Embodiment 44

The joint support, building surface construction, or method according to claim 43, wherein the polysaccharide component includes (or is) a hydrolyzed starch.

Embodiment 45

The joint support, building surface construction, or method according to any of claims 1-42, wherein the polysaccharide component of the adhesive comprises (or is) a dextrin, dextran, pullulan, xanthan gum, welan gum, gellan gum, gum Arabic, and chitosan.

Embodiment 46

The joint support, building surface construction, or method according to any of claims 1-45, wherein the adhesive further includes one or more of an adhesive, a rheology modifier, a tackifier or a solvent.

Embodiment 47

The joint support, building surface construction, or method according to any of claims 1-45, wherein the adhesive further includes a fatty acid such as oleic acid.

Embodiment 48

The joint support, building surface construction, or method according to any of claims 1-47, wherein the joint compound includes at least 50% calcium carbonate (e.g., at least 75%) on a dry weight basis.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A building surface construction using a joint support, the building surface construction comprising:

a first building surface panel;

a second building surface panel adjacent to the first building surface panel so as to form a joint between an edge of the first building surface panel and an edge of the second building surface panel;

an inner layer of joint compound covering the joint and extending over a portion of the first building surface panel and a portion the second building surface panel, the joint compound comprising at least 50 wt % calcium carbonate; and a joint support adhered to the inner layer of joint compound, the joint support comprising:

a longitudinal support strip including a first end, a second end, a first side edge, a second side edge, an inner surface, and an outer surface, wherein the inner surface of the support strip is formed by paper and has a critical wax strength number of at least 18; and an inner layer of adhesive distributed over the inner surface of the longitudinal support strip and bonded to the inner layer of joint compound, the adhesive of the inner layer comprising a polysaccharide.

2. A method forming the building surface construction according to claim 1, the method comprising:

applying an inner layer of joint compound over a joint between a first building surface panel and a second building surface panel;

placing the inner surface of the joint support against the inner layer of joint compound so as to bridge the joint between the first building surface panel and the second building surface panel while the inner layer of joint compound is wet; and allowing the inner layer of joint compound to dry.

3. A building surface construction according to claim 1, wherein the inner layer of adhesive is provided in a pattern over the inner surface of the longitudinal support strip.

4. A building surface construction according to claim 1, wherein the inner layer of adhesive extends from the first end of the support strip to the second end of the support strip.

5. A building surface construction according to claim 1, wherein the inner layer of adhesive is embedded in the support strip.

6. A building surface construction according to claim 1, wherein the support strip is formed by a sheet of fibrous material.

7. A building surface construction according to claim 1, wherein the support strip includes a structural body and an inner facing sheet disposed on the structural body that forms the inner surface of the support strip.

8. A building surface construction according to claim 7, wherein the structural body includes a first flange and a second flange, and wherein the joint support includes a flexible hinge between the first flange and the second flange.

9. A building surface construction according to claim 1, wherein the building surface construction further comprises a outer layer of joint compound disposed over the joint support, the joint compound of the outer layer comprising at least 50 wt % calcium carbonate, and wherein the joint support further comprises an outer layer of adhesive distributed over the outer surface of the support strip and bound to the outer layer of joint compound, the adhesive of the outer layer comprising a polysaccharide.

10. A building surface construction according to claim 1, wherein a length of the joint support is at least 4 feet.

11. A building surface construction according to claim 1, wherein the adhesive includes at least 50 wt % polysaccharide on a dry weight basis.

12. A building surface construction according to claim 1, wherein the polysaccharide component of the adhesive comprises a starch.

13. A building surface construction according to claim 1, wherein the polysaccharide component of the adhesive comprises a dextrin, dextran, pullulan, xanthan gum, welan gum, gellan gum, gum Arabic, and chitosan.

14. A building surface construction according to claim 1, wherein the adhesive further includes a fatty acid.

15. A building surface construction using a joint support, the building surface construction comprising:

a first building surface panel;

a second building surface panel adjacent to the first building surface panel so as to form a joint between an edge of the first building surface panel and an edge of the second building surface panel;

an inner layer of joint compound covering the joint and extending over a portion of the first building surface panel and a portion the second building surface panel; and a joint support adhered to the inner layer of joint compound, the joint support comprising:

a longitudinal support strip including a first end, a second end, a first side edge, a second side edge, an inner surface, and an outer surface, wherein the inner surface of the support strip is formed by paper and has a critical wax strength number of at least 18; and an inner layer of adhesive distributed over the inner surface of the longitudinal support strip and bonded to the inner layer of joint compound, the adhesive of the inner layer comprising a polysaccharide.

16. A building surface construction using a joint support, the building surface construction comprising:

a first building surface panel;

a second building surface panel adjacent to the first building surface panel so as to form a joint between an edge of the first building surface panel and an edge of the second building surface panel;

an inner layer of joint compound covering the joint and extending over a portion of the first building surface panel and a portion the second building surface panel, the joint compound comprising at least 50 wt % calcium carbonate;

a joint support adhered to the inner layer of joint compound, the joint support comprising:

a longitudinal support strip including a first end, a second end, a first side edge, a second side edge, an inner surface, and an outer surface; and an inner layer of adhesive distributed over the inner surface of the longitudinal support strip and bonded to the inner layer of joint compound, the adhesive of the inner layer comprising a polysaccharide; and an outer layer of joint compound disposed over the joint support, the joint compound of the outer layer comprising at least 50 wt % calcium carbonate, wherein the joint support further comprises an outer layer of adhesive distributed over the outer surface of the support strip and bound to the outer layer of joint compound, the adhesive of the outer layer comprising a polysaccharide.

* * * * *